United States Patent [19]

Ferri

[11] Patent Number: 4,841,655

[45] Date of Patent: Jun. 27, 1989

[54] TOY FIREARM FOR FIRING PROJECTILES BY COMPRESSED AIR, WITH THE PISTON OF THE CYLINDER-PISTON SYSTEM ATTACHED TO THE HAMMER OF THE FIREARM

[76] Inventor: Giampiero Ferri, Via Vecchia Fiesolane No. 74, Florence, Italy

[21] Appl. No.: 202,880

[22] Filed: Jun. 6, 1988

[30] Foreign Application Priority Data

Jun. 11, 1987 [IT] Italy ..... 9410 A/87

[51] Int. Cl.[4] ..... F41B 11/02

[52] U.S. Cl. ..... 42/58; 124/66

[58] Field of Search ..... 42/54, 58; 124/63, 64, 124/65, 66; 446/473

[56] References Cited

U.S. PATENT DOCUMENTS

| | | | |
|---|---|---|---|
| 2,237,678 | 4/1941 | Lohr et al. | 124/66 |
| 2,708,430 | 5/1955 | Smith | 124/66 |
| 2,922,412 | 1/1960 | Hosbach, Jr. | 124/66 |

*Primary Examiner*—Deborah L. Kyle
*Assistant Examiner*—Michael J. Carone
*Attorney, Agent, or Firm*—Hopgood, Calimafde, Kalil, Blaustein & Judlowe

[57] ABSTRACT

A device in the form of a hammer or firing-pin, movable angularly, with an arched attachment forming a piston, the cylinder being extended like an arched recess with its axis almost coinciding with that of the articulated joint of the hammer, and with the spring for acting on the piston acting on the said device by urging it angularly.

6 Claims, 4 Drawing Sheets

TOY FIREARM FOR FIRING PROJECTILES BY COMPRESSED AIR, WITH THE PISTON OF THE CYLINDER-PISTON SYSTEM ATTACHED TO THE HAMMER OF THE FIREARM

SPECIFICATION

The subject of the invention is a toy firearm operated by compressed air for firing light projectiles, of the type comprising a barrel for accommodating the projectile, a cylinder-piston system, a spring for acting on the piston to cause it to spring forward in a resilient power stroke with expulsion of the air compressed into the barrel where the projectile is placed, devices for loading the spring and displacing the piston in the reverse stroke to the power stroke, and firing mechanisms for actuating firing.

According to the invention, the toy firearm comprises a device in the form of a hammer or firing-pin, movable angularly round a pin, with an attachment forming a piston; the cylinder extends like an arched recess with its axis almost coinciding with that of the said pin the spring for acting on the piston acts on the said device by urging it angularly; and the trigger mechanisms release the said device for it to accomplish its power stroke.

The toy firearm can be an imitation of real firearms of various kinds, but it is of advantage if it is of the type imitating a revolving cylinder-operated firearm, in particular a revolver, with chambers for the projectiles to be fired; the revolving cylinder is moved angularly by the same hammer device, and the cylinder forms a base with a firing hole aligned with the chamber every time this comes into the firing position. The revolving cylinder or a part of it can be attached to spring devices for urging the said revolving cylinder or the said part of it axially against the said base, to ensure sealing round the said hole.

In practice, the revolving cylinder can comprise a first part assembled so that it can be moved angularly, a second part forming the chambers for the projectiles to be fired, and a spring reacting between the two said parts which urges the said second part against the said base of the cylinder.

According to one possible embodiment, the firing mechanisms have a retaining detent for holding back the hammer device in the cocked position until actuated by the firing mechanism itself. Alternatively, the said firing mechanisms have an attachment that acts on the said hammer device so as to cock it and then let go of it for firing.

The invention will be better understood if the specification is studied in conjunction with the attached drawings; these illustrate one practical embodiment of the invention, to provide a non-limitative example. In these drawings FIGS. 1 and 2 represent in side view and partial sectional view a toy firearm according to the invention in the rest position, that is to say after a projectile has been fired, and in the cocked position ready for firing;

Figure 1:
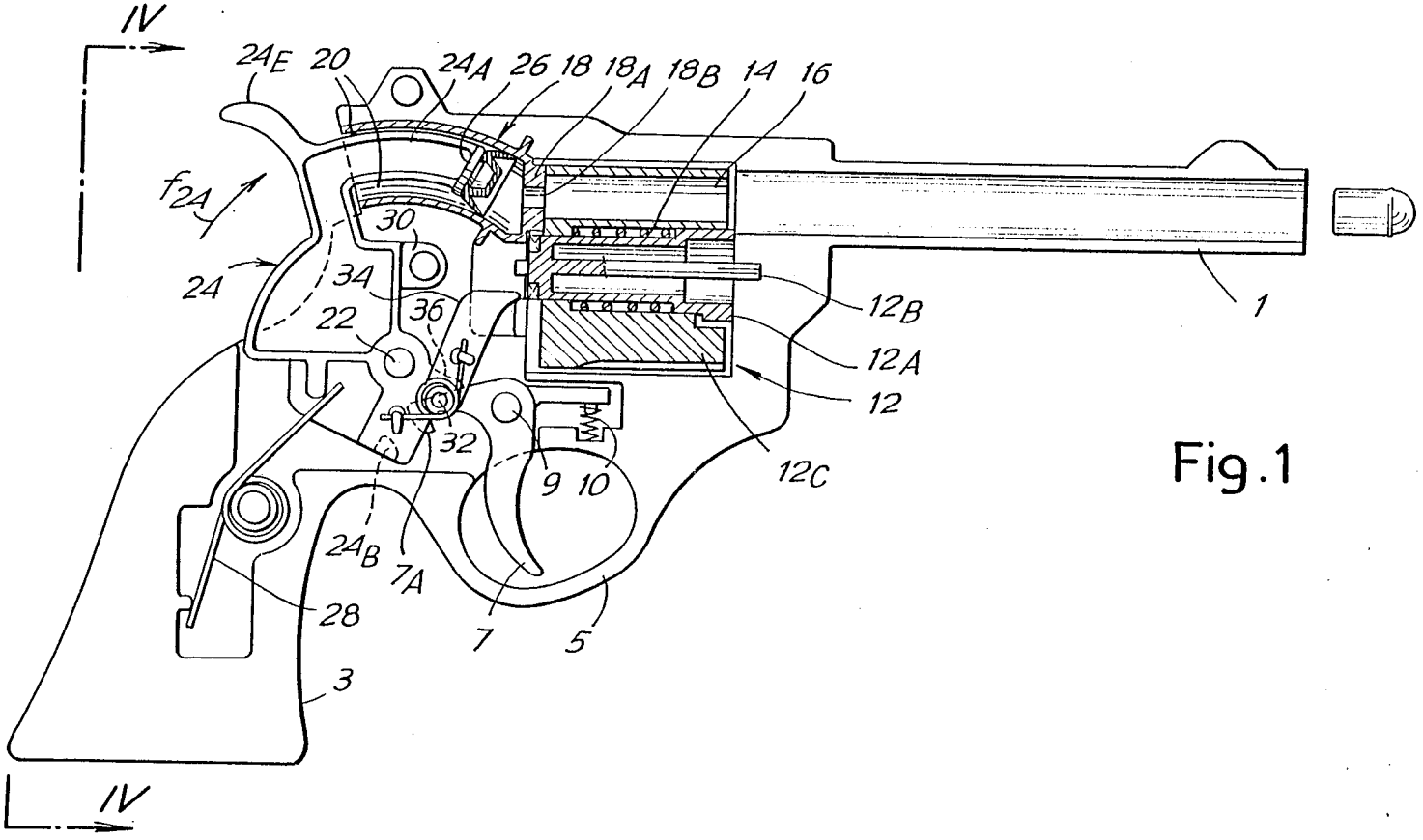
Figure 2:
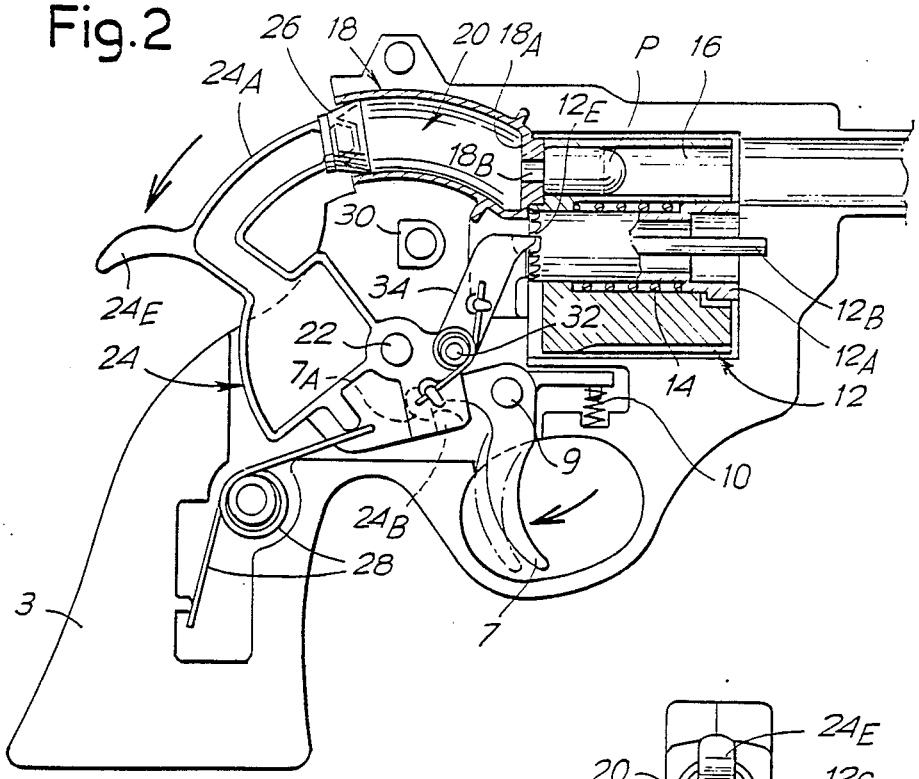
Figure 3:
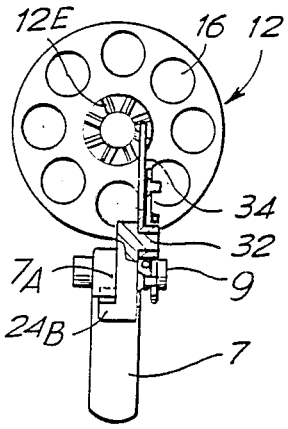
FIG. 3 represents an axial diagrammatic view of the working parts.

As illustrated in the attached drawings, and with particular reference initially to FIGS. 1 to 3, the toy firearm concerned, produced in the form of a revolver, exhibits the barrel 1, the butt 3 and the guard 5 for the trigger 7. The trigger is hinged at 9 onto the casing and is urged by a spring 10 to the forward position, from which it is to be displaced by a finger to trigger firing. 12 is the generic number indicating the revolving cylinder, which is made up of an interior part 12A forming the axial articulation joint 12B in the casing and an exterior part 12C which is rotationally engaged in the part 12A but is resiliently urged in the direction of retraction vis-à-vis the barrel by the action of a spring 14 reacting between the two parts 12A and 12C. The part 12C comprises a series of chambers 16 distributed round the axis of the revolving cylinder and parallel with the said axis, serving as housings for the projectiles; every time the revolving cyinder is trigger-operated, each of the chambers 16 respectively is made to move into alignment, one after the other, with the barrel 1 to enable the projectile to be fired. P indicates the projectile positioned in the chamber 16 aligned with the barrel 1 and ready to be fired, which is effected by compressed air. At the back of the revolving cylinder 12 is a fixed structure, indicated generically by the numeral 18, which constitutes an air-tight surface with the rear base of the revolving cylinder 12C, corresponding at least with the chamber 16 in immediate alignment with the barrel 1; the resilient urging operated on the device 12C by the spring 14 ensures pneumatic sealing between the chamber 16 in the firing position and the part 18A of the fixed structure 18 corresponding with the position of the barrel 1. The structure 18 forms a recess with a compressed-air cylinder, indicated by 20, which is arched in a circle with its axis corresponding with a pin 22 formed by the casing, and is in contact with the chamber 16, which is immediately brought into alignment with the barrel, by means of a hole 18B going through the part 18A of the structure 18, directly corresponding with the axis of the chamber 16 aligned with the barrel. 24 indicates a device pivoting round the pin 22, which device is shaped like the traditional hammer or firing-pin of a revolver but is however characteristically designed with an arched attachment 24A entering the recess of the arched cylinder 20 and exhibiting at the end a packing gasket 26 acting as a piston inside the cylindrical recess 20. The device 24 shaped like a hammer or firing-pin is urged by a spiral spring 28 reacting on a support of the butt 3, such that the device 24 is urged by the said spring 28 in the direction of the arrow $f_{24}$ in FIG. 1, thus thrusting the piston 26 towards the part 18A constituting the end base of the cylindrical recess 20. The numeral 30 indicates a rabbet formed by the casing of the toy firearm in order to delimit the final stop position of the device 24 for it to be fired by the action of the spring 28. The device 24 exhibits a detent 24B that operates in conjunction with a retaining detent 7A of the trigger 7. A thin metal sheet 34 is hinged by means of a pin 32 onto the device 24, and is urged by a spring 36 wound round the pin 32 so that its end presses on the circular crown gear 12E coaxial with the shaft 12B of the revolving cylinder 12. This arrangement ensures that the revolving cylinder is moved forward every time the hammer device 24 is cocked.

In the position shown in FIG. 1, the device 24 is supported on the pawl 30 and the piston 26 is in the vicinity of the part 18A of the structure 18 forming the cylinder 20; the trigger is in the rest position and the thin metal sheet 34 is ready to act on the crown gear 12E of the revolving cylinder 12. To prepare for firing, and so to load the toy firearm, the device 24 is acted on, and in particular the attachment 24E of the device 24, in the direction opposite to that indicated by the arrow f24 in order to bring it into the position shown in FIG. 2 against the action of the spring 28. With this displacement of the device 24 round the pin 22, the thin metal sheet 34, urged by the pin 32, acts on the crown gear 12E, causing the revolving cylinder 12 to be moved round angularly by one step so that one of the chambers 16—containing a projectile P—is brought into alignment with the barrel 1 and so in alignment with the part 18A of the structure 18; on the completion of the operation of cocking the device 24 by action on the attachment 24E the detent 24B of the device 24 becomes engaged in the detent 7A of the trigger 7 after the said detent 7A has been resiliently pressed down to permit the detent 24B to pass. The toy firearm is thereby loaded in the position illustrated in FIG. 2, and is kept in this position by the action of the retaining detent 7A of the trigger 7. In this position the piston 26 has been brought away from the part 18A of the structure 18, thereby establishing an air chamber for purposes of propulsion. As soon as the trigger 7 is pressed, the detent 24B is released from the trigger and the device 24 is subjected to the action of the spring 28 and propelled rapidly in the direction of the arrow $f_{24}$, causing the piston 26 to slide in the cylindrical recess 20 and so causing the air to be compressed with consequent propulsion of the projectile P due to the escape of air through the hole 18B in the part 18A and the recess 16 which is aligned with the barrel 1. This enables the projectile to be fired. And thus the toy firearm reverts to the position shown in FIG. 1.

Figure 4:
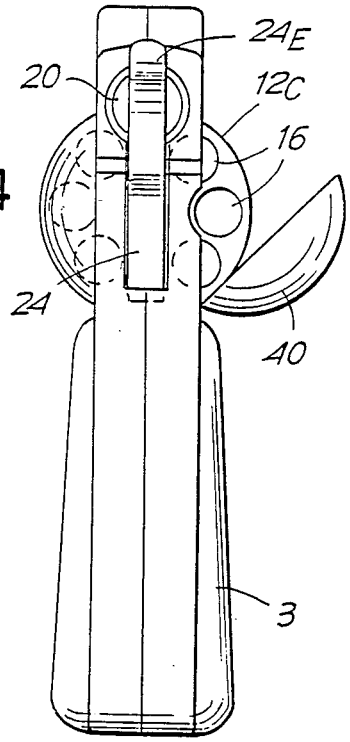
FIG. 4 is a view as seen from the arrow IV in FIG. 1.

The projectiles are replenished through opening a small cover 40 in the side, which allows the projectiles to be inserted in the chambers 16 that are empty (see FIG. 4).

Figures 5, 7:
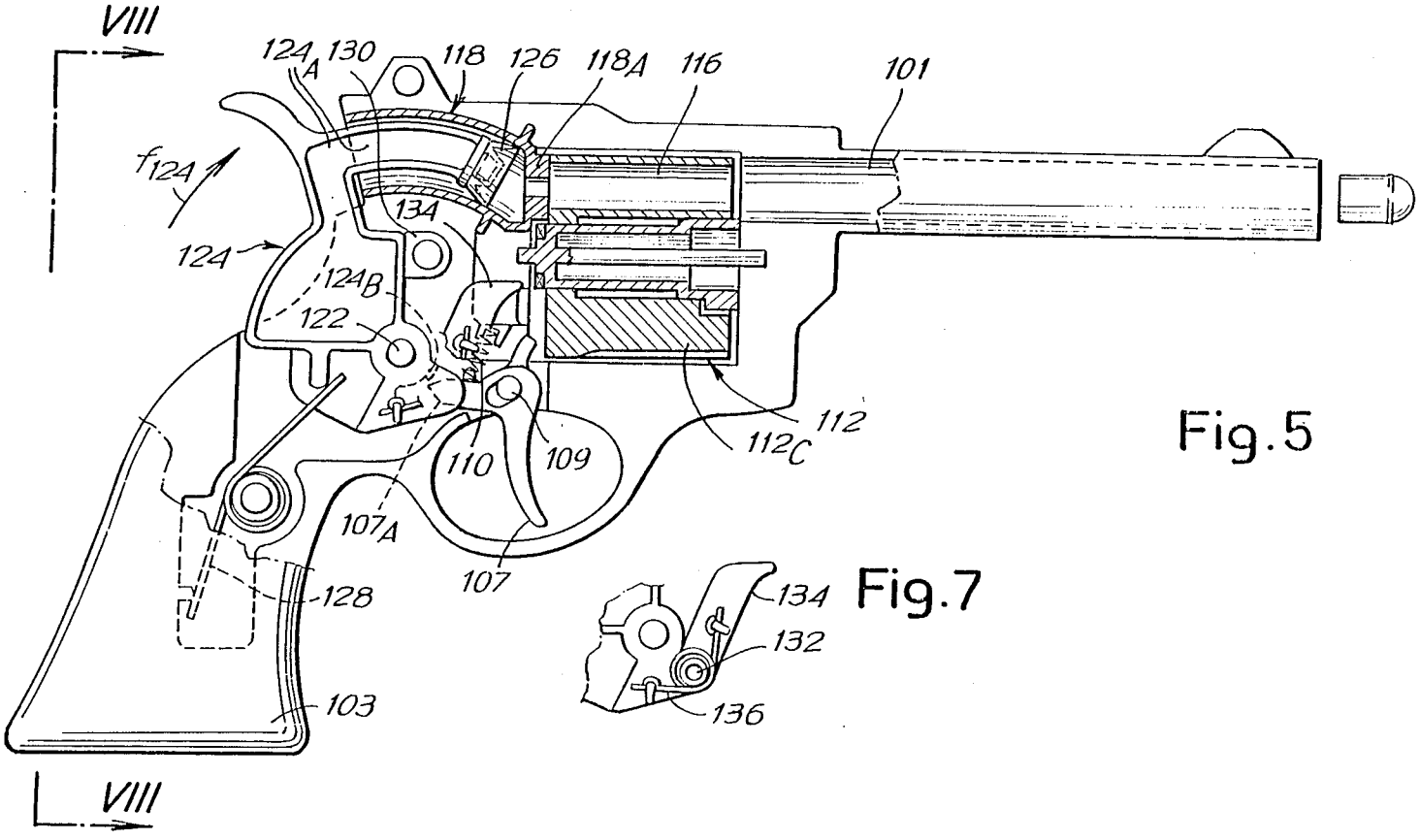
FIGS. 5 and 6 represent, like FIGS. 1 and 2, another version of the toy firearm according to the invention with automatic cocking and firing controls.
FIG. 7 shows a part of FIG. 5 in detail.
Figure 6:
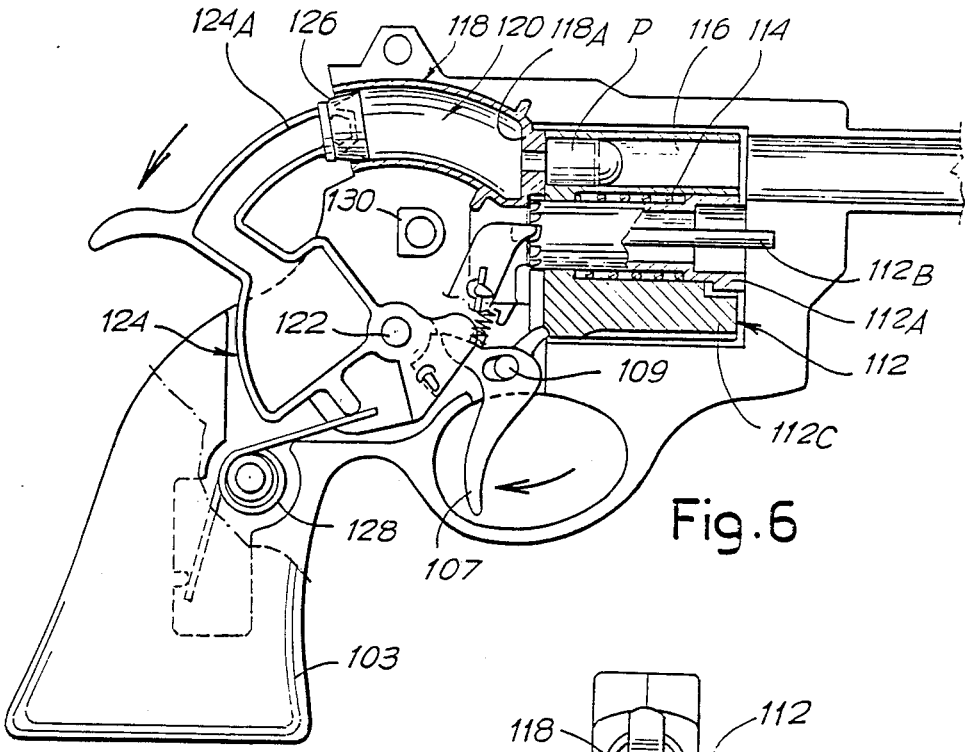
Figure 8:
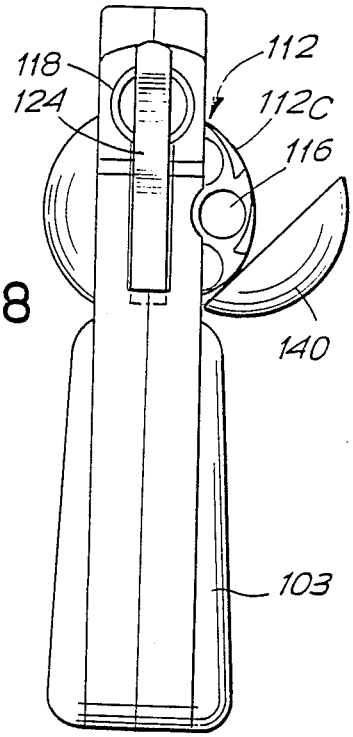
FIG. 8 is a view as seen from the arrow VIII of FIG. 5.

In the version illustrated in FIGS. 1 to 4, two separate operations are involved, cocking, that is to say loading the firearm (by action on the device 24, 24E) and firing (by action on the trigger 7). In FIG. 5 and onwards an embodiment is envisaged wherein action on the trigger alone effects the loading and the firing of the projectile simultaneously.

In FIG. 5 and onwards an arrangement is envisaged wherein direct action on the trigger procures both the cocking that is to say loading of the device 24 in the shape of a hammer or firing-pin and the action of firing for compressed-air discharge of the projectile. In this version the corresponding devices are indicated by the same reference numerals as those used for the previous version augmented by "100". In a different arrangement from that in the previous version, the trigger 107 is engaged on the pin 109 not in a manner so that it merely rotates but so that it can slide, and the reaction spring 110 is located in a different position from that of the spring 10 in the preceding version. The trigger does not have the detent 7A but an attachment 107A; similarly the device 124 has no detent like the detent 24A but an attachment 124A in the vicinity of the articulated joint 122 and capable of acting in conjunction with the projection 107A. This arrangement is such that through action on the trigger 107 against the action of the return spring 110 the attachment 107A is caused to act on the attachment 124A so as to actuate the rotation of the device 124 against the action of the spring 128 in the direction opposite to that of the arrow $f_{124}$, in such a way that the load on the spring 128 is increased and the piston packing 126 is moved away from the perforated part 118A of the structure 118. Pressing the trigger 107 causes the trigger itself to slide on the pin 109 and the release of the attachment 107A from the attachment 124A, with the result that—after action on the spring 134 to cause the revolving cylinder 112 to move round one step angularly—the trigger is automatically released from the device 124, which is then fired by the action of the spring 128, causing the air to be compressed and hence pneumatic propulsion of the projectile P in the chamber 116 that has just been aligned with the barrel 101. In this instance, therefore, a single operation of control effects the action of both cocking and firing to release pneumatic propulsion, in the form of a single action on the trigger 107 instead of the two separate operations that are necessary with the preceding version.

In both cases the spring 14 or 114, by pressing the part 12C or 112C of the revolving cylinder against the perforated part 18A or 118A at the end of the recess 20 or 120, ensures that the system is essentially airtight as regards any escape of the compressed air that is thrust by the piston 26 or 126 for propelling the projectile P, so as to avoid loss of power as far as possible. This thrust action can result in a comparatively high degree of friction, in which case the force of the spring 128 can be reduced, entailing a shorter range for the projectile; the effort required to operate the trigger 107 can likewise be reduced in this way. Questions of this kind do not arise in the case of the dual operation solution—cocking of the hammer through action on the attachment 24A and firing through action on the trigger 7—illustrated in FIGS. 1 to 4.

The drawings, it should be understood, illustrate only one possible embodiment by way of example, as a practical demonstration of the invention, which can take the form of a variety of embodiments and arrangements without any departure from the scope of its underlying concept. The appearance of reference numerals in the claims that follow is intended to make it easier for the reader to relate the claims to the specification and to the drawings, and does not imply any limitation on the scope of the protection represented by the claims.

I claim:

1. A toy firearm operated by compressed air for firing projectiles comprising:

a body portion including a butt (3) with a trigger assembly (5,7) associated therewith, and incuding a barrel (1) extending from said body portion adapted to accomodate a projectile therein, a trigger-operated firing pin mechanism (24,124) pivotally mounted about a pin (22,122) and having a firing pin (24A,124A) extending therefrom having a piston (26,126) located at its free end, with a manually operable cocking means (24E) also extending from said firing pin mechanism (24,124), said firig pin (24A,124A) moving in an arcuate path about said pin (22,122), an arcuately shaped cylinder (20,120) cooperably associated with said firing pin mechanism (24,124) and having an axis corresponding substantially with the axis of said pin (22,122), said firing pin (24A, 124A) and its piston (26,126) being disposed to move in and out of said arcuate cylinder (20,120) when said firing pin mechanism (24,124) is actuated, a loading spring (28,128) mounted within said butt (3) operated by said cocking means (24E), and trigger means (7,107) releasably coupled to said firing pin mechanism and said loading spring.

2. The toy firearm as in claim 1, including a revolving cylinder (12,112) having a plurality of chambers (16,116) therein for receiving projectiles, said revolving cylinder being located forward of said arcuate cylinder (20,120) and before said barrel (1) such that each of said chambers (16,116) can be aligned with said arcuate cylinder (20,120) and said barrel (1), said revolving cylinder being operated into a firing position by pivotally mounted element (34,134) coacting with said trigger means (7,107) and coacting means (12E) on said revolving cylinder (12,112) to effect rotational movement of said revolving cylinder.

3. The toy firearm as in claim 1, wherein the arcuate cylinder (20,120) has a restricted opening (18B) at its discharge end (18A,118A) to enable pressure build-up of air in said cylinder (20,120) during a firing cycle.

4. The toy firearm as in claim 3, wherein the revolving cylinder (12,112) is made up of a central cylindrical portion (12A,112A) mounted within an outer cylindrical portion (12C,112C) containing said chambers (16,116), said central portion being surrounded by a spring (14,114) adapted to urge said outer cylindrical portion (12A,112A) axially against said discharge end (18A,118A) of said arcuate cylinder (20,120) to ensure sealing contact with said opening (18B).

5. The toy firearm as in claim 4, wherein the trigger means (7) has a retaining detent (7A) for lockingly engaging said firing pin mechanism (24,124) when said firearm is placed in a cocked position via said cocking means (24E).

6. The toy firearm as in claim 4, wherein said firing pin mechanism (124) has a locking means (124B) which releasably connects to trigger locking means (107A) of trigger means (107) which has a slotted opening which engages pin 109 and slides therealong so as to enable cocking of said firearm and release thereof when said trigger means is manually operated.

* * * * *